US007744725B2

(12) United States Patent
Kubota et al.

(10) Patent No.: US 7,744,725 B2
(45) Date of Patent: Jun. 29, 2010

(54) PAPER QUALITY IMPROVER

(75) Inventors: Kazuo Kubota, Wakayama (JP); Zenbei Meiwa, Wakayama (JP); Hiromichi Takahashi, Wakayama (JP); Yoshihiro Hasebe, Wakayama (JP)

(73) Assignee: Kao Corporation, Tokyo (JP)

( * ) Notice: Subject to any disclaimer, the term of this patent is extended or adjusted under 35 U.S.C. 154(b) by 388 days.

(21) Appl. No.: 10/525,458

(22) PCT Filed: Aug. 27, 2003

(86) PCT No.: PCT/JP03/10867

§ 371 (c)(1),
(2), (4) Date: Sep. 28, 2005

(87) PCT Pub. No.: WO2004/020736

PCT Pub. Date: Mar. 11, 2004

(65) Prior Publication Data

US 2006/0106137 A1 May 18, 2006

(30) Foreign Application Priority Data

Aug. 27, 2002 (JP) ..... 2002-247754
Aug. 30, 2002 (JP) ..... 2002-252659

(51) Int. Cl.
*D21H 17/29* (2006.01)
*D21H 17/42* (2006.01)
*D21H 21/22* (2006.01)

(52) U.S. Cl. ..... 162/168.1; 162/158; 162/164.1; 162/175; 162/185; 526/303.1; 526/307.4

(58) Field of Classification Search ..... 162/158, 162/164.1, 168.1, 175, 185; 526/303.1, 307.4
See application file for complete search history.

(56) References Cited

U.S. PATENT DOCUMENTS 3,632,535 A * 1/1972 Gramera et al. ..... 524/734
4,124,439 A 11/1978 Dessauer
4,908,240 A * 3/1990 Auhorn et al. ..... 427/391
4,940,741 A * 7/1990 De Wacker et al. ..... 524/47
4,978,427 A * 12/1990 Pfohl et al. ..... 162/168.2
5,167,766 A * 12/1992 Honig et al. ..... 162/164.1
5,274,055 A * 12/1993 Honig et al. ..... 524/47
5,431,783 A * 7/1995 Honig ..... 162/164.1
5,536,764 A * 7/1996 Nguyen et al. ..... 524/53
6,146,494 A * 11/2000 Seger et al. ..... 162/9
6,193,843 B1 * 2/2001 Tsai et al. ..... 162/175
6,753,377 B1 * 6/2004 Niinikoski et al. ..... 524/734
6,800,675 B1 * 10/2004 Pfalz et al. ..... 524/47
2002/0053413 A1 * 5/2002 Zhang et al. ..... 162/168.1
2002/0066540 A1 * 6/2002 Chen et al. ..... 162/17

FOREIGN PATENT DOCUMENTS

JP 54-34409 A 3/1979
JP 3-227489 A 10/1991
JP 8-170296 A 7/1996
JP 2971447 B1 8/1999
JP 11-302992 A 11/1999
JP 2000-265389 A 9/2000
JP 3283248 B2 3/2002
JP 2002-115197 A 4/2002
WO WO-00/03090 A1 1/2000
WO WO-00/46264 A1 8/2000

OTHER PUBLICATIONS

Brandrup et al, Polymer Handbook (4th Edition) John Wiley & Sons. (1999), [online] Table: Glass Transition Temperatures of Polymers [retrieved on May 12, 2006]. Retrieved from the internet: URL <http://www.knovel.com/knovel2/Toc.jsp?BookID=1163&VerticalID=0>.*

Wurzburg, O.B. ("Modified Starches: Properties and Uses" CRC Press, Inc. Boca Raton, FL, 1986, pp. 116-117.*

Carraher, Jr. "Polymer Chemistry" 4th ed, Marcel Dekker, Inc., 1996, p. 28.*

Brandrup et al, editors, Polymer Handbook, 3rd ed, John Wiley and Sons, 1989, pp. V/71-V/72.*

* cited by examiner

*Primary Examiner*—Steven P Griffin

*Assistant Examiner*—Dennis Cordray

(74) *Attorney, Agent, or Firm*—Birch, Stewart, Kolasch & Birch, LLP

(57) ABSTRACT

An additive for internal addition, which improves the paper qualities of a pulp sheet, such as stiffness and bulk which includes a polymer emulsion containing a natural cationic polymer (A) or synthetic cationic polymer (A') and polymer particles (B) containing vinyl monomer-derived structural units.

9 Claims, No Drawings

PAPER QUALITY IMPROVER

This application is a 371 of PCT/JP03/10867, filed Aug. 27, 2003 and claims priority to Japanese Application No. 2002247754, filed Aug. 27, 2002, and Japanese Application No. 2002252659, filed Aug. 30, 2002.

FIELD OF THE INVENTION

The present invention relates to an additive for internal addition, which is useful for improving the paper qualities of a pulp sheet.

BACKGROUND OF THE INVENTION

The thickness of paper is decreased with lighter weight of paper, high-speed papermaking and incorporation of higher amount of deinked pulp for the purpose of reducing burden on the environment and reducing transport costs in recent years. While bulky paper is desired, the stiffness of paper is proportional with the cube of thickness, and thus a decrease in the thickness of paper causes a reduction in stiffness.

The stiffness of paper exerts significant influence on feeling of high qualities, operativeness in papermaking and printing, the durability of a box, etc., and a reduction in stiffness gives a feeling of low qualities and causes paper clogging in operation and swelling of a box etc.

Techniques of improving stiffness include a method (1) wherein unit pulp amount (basis weight) is increased, a method (2) wherein a paper-strengthening agent or the like is used, etc., but there is a problem that in the method (1), the amount of necessary pulp is increased and the weight of paper is increased, and in the method (2), paper strength (difficulty in tearing paper) is improved and stiffness is somewhat improved, but satisfactory levels are not reached.

JP-A 8-170296 discloses a paper internal agent comprising fine polymer particles of vinyl monomers or diene monomers with a dispersant cationic polyvinyl alcohol having a mercapto group, and JP-A 11-302992 discloses an additive for papermaking, which is based on grafted starch obtained by graft-copolymerizing (meth)acrylamide-containing monomers while maintaining the form of starch particles without gelatinizing starch, and these preparations improve stiffness to a certain extent, but are still unsatisfactory.

With respect to techniques of improving the bulk of paper, Japanese Patent No. 2971447 discloses a polyvalent alcohol/fatty acid ester compound, and Japanese Patent No. 3283248 discloses a paper quality improver having a water freeness of 4% or more and improving at least two items selected from bulk, whiteness and opaqueness, but there is also demand for improvement of stiffness.

SUMMARY OF THE INVENTION

The object of the present invention is to provide a paper quality improver for internal addition, which improves the stiffness, bulk etc. of a pulp sheet. Particularly, the object of the present invention is to provide a paper quality improver for internal addition, which is useful as a stiffness improver.

The present invention relates to a paper quality improver for internal addition, which comprises a polymer emulsion containing a natural cationic polymer (A) and polymer particles (B) containing at least vinyl monomer-derived structural units.

Further, the present invention relates to a pulp sheet wherein the paper quality improver for internal addition according to the present invention is contained in the surface and/or the inside of the pulp sheet.

Furthermore, the present invention relates to a method of improving the paper qualities of a pulp sheet, which comprises bringing the paper quality improver for internal addition according to the present invention into contact with pulp.

The present invention provides a method of improving the paper qualities of a pulp sheet, which comprises adding the paper quality improver for internal addition to pulp slurry at the time of papermaking. The present invention also provides use of the paper quality improver for internal addition as a stiffness improver.

The present invention relates to a paper quality improver for internal addition, which comprises a polymer emulsion containing a synthetic cationic polymer (A') having a viscosity of 20 mPa·s (50° C.) or more in the form of an aqueous solution (7 wt %) and a nitrogen content of 1.0 wt % or less and polymer particles (B) having a glass transition temperature (Tg) of 90° C. or less having vinyl monomer-derived structural units.

The present invention relates to a paper quality improver for internal addition, which comprises a polymer emulsion containing a natural cationic polymer (A) or a synthetic cationic polymer (A') and polymer particles (B) having a glass transition temperature (Tg) of 90° C. or less containing at least vinyl monomer-derived structural units. The synthetic cationic polymer (A') has a viscosity of 20 mPa·s (50° C.) or more in the form of an aqueous solution (7 wt %) and a nitrogen content of 1.0 wt % or less.

DETAILED DESCRIPTION OF THE INVENTION

The paper quality improver for internal addition according to the present invention comprises an emulsion containing a natural cationic polymer (A) and fine polymer particles (B) containing at least vinyl monomer-derived structural units. The reason that the paper quality improver for internal addition according to the present invention significantly improves stiffness and bulk is not certainly evident, but it is estimated that the natural polymer has a similar structure to that of pulp and thus has very strong affinity for pulp, and therefore the paper quality improver for internal addition according to the present invention, as compared with the conventional agent consisting of synthetic polymers represented by polyvinyl alcohol and fine particles of polymerized vinyl monomers, significantly increases the amount of the agent fixed, improves the efficiency due to spreading on the wet surface of pulp after fixation or during drying and heating, and improves the fixation of the agent/pulp interface, thus improving stiffness and bulk. The paper quality improver for internal addition according to the present invention exhibits a significant effect on improvement of stiffness, and is thus preferably used for the purpose of improving stiffness.

The paper quality improver for internal addition according to the present invention comprises a polymer emulsion containing a synthetic cationic polymer (A') having a viscosity of 20 mPa·s (50° C.) or more in the form of an aqueous solution (7 wt %) and a nitrogen content of 1.0 wt % or less and polymer particles having a glass transition temperature (Tg) of 90° C. or less having vinyl monomer-derived structural units. Even the synthetic polymer has strong affinity for pulp probably because it has specific substance values.

<Natural Cationic Polymer (A)>

The natural cationic polymer (A) used in the present invention is a polymer obtained from naturally occurring materials by procedures such as extraction and purification, which may further be chemically modified. The polymer is preferably the one having a glucose residue (starch residue, cellulose residue etc.) on the polymer skeleton thereof, which is for example cationic starch or cationic cellulose (particularly preferably the water-soluble one whose cationic group is a quaternary ammonium cationic group), and one kind of polymer may be used, or two or more kinds of polymers may be used as a mixture.

The cationic group includes an ammonium group or an amino group neutralized with an acid. The cationic group includes those groups neutralized preferably with hydrochloric acid, sulfuric acid, nitric acid, acetic acid, formic acid, maleic acid, fumaric acid, citric acid, tartaric acid, adipic acid, lactic acid etc.

The cationic starch or cationic cellulose is preferably the one represented by, for example, the following formula (1):

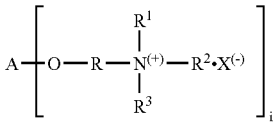

(1)

wherein A represents a starch residue or cellulose residue, R represents an alkylene or hydroxyalkylene group, $R^1$, $R^2$ and $R^3$ may be the same or different and each represent an alkyl group, aryl group or aralkyl group, or may form a heterocycle containing the nitrogen atom in the formula, $X^-$ represents a counterion of an ammonium salt, and i represents a positive integer.

The starch residue or cellulose residue is preferably a group wherein one hydroxyl group was removed from starch or cellulose.

R is preferably a C1 to C12, more preferably C1 to C3, alkylene or hydroxyalkylene group, particularly preferably a hydroxypropylene group.

$R^1$, $R^2$ or $R^3$ is preferably a C1 to C12, more preferably C1 to C3, alkyl group including a methyl group, ethyl group, i-propyl group, n-propyl group etc. Specific examples of $X^-$ include halogen ions such as ions of chlorine, iodine, bromine etc. and organic anions such as anions of sulfuric acid, sulfonic acid, methylsulfuric acid, phosphoric acid, nitric acid etc. i is determined depending on the substitution degree on the cation described above.

In the present invention, the natural cationic polymer is produced by known methods. The natural cationic polymer is produced for example by cationizing corn starch or the like with a cationizing agent in a water/alcohol system, followed by neutralization with acetic acid, washing with water and drying. Generally, the regulation of the molecular weight thereof (the viscosity of an aqueous solution thereof) can be easily carried out by adding a strong acid such as hydrochloric acid to such a cationized slurry and then heating it.

The cationic starch can be obtained by reacting glycidyl trimethyl ammonium chloride or 3-chloro-2-hydroxypropyl trimethyl ammonium chloride with raw starch or processed starch from corn, potato, tapioca, wheat, rice etc. Alternatively, it can be obtained by quaternarizing dimethylaminoethylated starch. Alternatively, it can be obtained by reacting 4-chlorobutene trimethyl ammonium chloride with starch. On the other hand, the cationic cellulose can be obtained for example by subjecting hydroxyethyl cellulose to the reaction described above.

The nitrogen content of the natural cationic polymer is preferably 0.05 to 1 wt %, particularly preferably 0.07 to 0.9 wt %, from the viewpoint of improvement of stiffness. In respect of the effect of improvement of stiffness, nitrogen wt % (referred to hereinafter as N %) is preferably 0.05 wt % or more, or in respect of the effect of improvement of stiffness, N % is preferably 1 wt % or less. N % is analyzed by the Kjeldahl method (JIS K 8001).

Because a higher solid content of the emulsion is desired in consideration of productivity etc. in addition to handling convenience and handling, the molecular weight of the natural cationic polymer can be decreased in such a range that the effect of the present invention is not hindered. When the molecular weight of the natural cationic polymer is expressed in terms of the viscosity of an aqueous solution thereof, the viscosity of 7 wt % aqueous solution at 50° C. (Brookfield viscometer, Rotor No. 2, 60 rpm) is preferably 40 to 10,000 mPa·s, more preferably 50 to 8,000 mPa·s.

For preventing aging etc., a functional group including an ether group such as a hydroxyalkyl group and an ester group such as an acetyl group may be introduced into the natural cationic polymer in the present invention insofar as the effect of the present invention is not hindered.

For the purpose of improving polymerization stability and mechanical stability in the present invention, other polymers (e.g. synthetic cationic polymer or nonionic polymer) than the natural cationic polymer may be used in combination with the natural cationic polymer. Preferably, the synthetic cationic polymer is cationic polyvinyl alcohol, the nonionic polymer is a semi-synthetic water-soluble polymer such as methyl cellulose, hydroxyethyl cellulose or soluble starch, or a synthetic water-soluble polymer such as polyvinyl alcohol. The amount of the other polymers than the natural cationic polymer is preferably 0 to 100 parts by weight, more preferably 0 to 50 parts by weight, relative to 100 parts by weight of vinyl monomers constituting the polymer particles (B).

<Synthetic Cationic Polymer (A')>

The nitrogen content (N %, analyzed by the Kjeldahl method) of the synthetic cationic polymer used in the present invention is preferably 0.05 wt % or more, more preferably 0.07 wt % or more, still more preferably 0.1 wt % or more, or is preferably 1.0 wt % or less, more preferably 0.9 wt % or less, still more preferably 0.7 wt % or less. The synthetic cationic polymer is preferably a polymer wherein cationic groups are present such that the nitrogen content is in the above range. The cationic groups may be introduced by polymerizing cationic monomers or by introducing the cationic groups into the polymer through reaction or the like. In a nitrogen content in the above range, the effect of improving paper qualities such as stiffness and bulk in the present invention can be sufficiently obtained.

The cationic group may be an ammonium group or an amino group neutralized with hydrochloric acid, sulfuric acid, nitric acid, acetic acid, formic acid, maleic acid, fumaric acid, citric acid, tartaric acid, adipic acid, lactic acid or the like.

When the molecular weight of the synthetic cationic polymer used in the present invention is expressed in terms of the viscosity of an aqueous solution thereof, the viscosity of 7 wt % aqueous solution as determined by a measurement method described later (Brookfield viscometer, 60 rpm, 50° C.) is preferably 20 mPa·s or more, more preferably 40 mPa·s or more, still more preferably 65 mPa·s or more, and the upper limit is preferably 10,000 mPa·s or less, more preferably 8,000 mPa·s or less, still more preferably 5,000 mPa·s or less.

This range is preferable in that the cationic polymer can be easily handled, the solid content of the emulsion can be increased, and the paper qualities of a pulp sheet, such as stiffness and bulk, can be achieved.

The synthetic cationic polymer includes cationic polymers having cationic polymerizable units derived from monomers having polymerizable unsaturated groups (for example, vinyl group, vinylene group, vinylidene group, allyl group etc.), preferably polymerizable units based on (meth) acrylic acid, styrene, vinyl pyridine, vinyl imidazoline and diallyl amine represented by the general formulae (1') and (2) to (5):

(1')

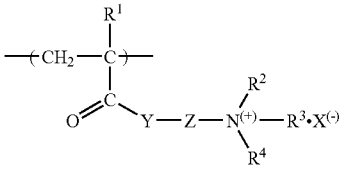

wherein $R^1$ represents a hydrogen atom or a methyl group, $R^2$, $R^3$ and $R^4$ may be the same or different and each represent a hydrogen atom or a C1 to C22 alkyl or substituted alkyl group, Y represents —O— or —NH—, Z represents a C1 to C12 alkylene or hydroxyalkylene group, and $X^-$ represents an anion.

Z is preferably a C2 to C6, more preferably C1 to C3, alkylene or hydroxyalkylene group, particularly preferably a hydroxypropylene group.

Each of $R^2$, $R^3$ and $R^4$ is preferably a C1 to C12, more preferably C1 to C3, alkyl group such as a methyl group, ethyl group, i-propyl group or n-propyl group.

Specific examples of $X^-$ include halogen ions including ions of chlorine, iodine and bromine and organic anions including anions of sulfuric acid, sulfonic acid, methylsulfuric acid, phosphoric acid and nitric acid.

(2)

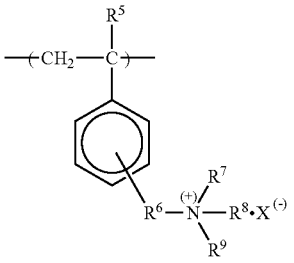

wherein $R^5$ represents a hydrogen atom or a methyl group, $R^6$ represents a C1 to C3 alkylene group, $R^7$, $R^8$ and $R^9$ may be the same or different and each represent a hydrogen atom or a C1 to C22 alkyl group which may have a substituent group, and $X^-$ has the same meaning as defined above.

$R^6$ is preferably a methylene group. Each of $R^7$, $R^8$ and $R^9$ is preferably a C1 to C12, more preferably C1 to C3, alkyl group such as a methyl group, ethyl group, i-propyl group or n-propyl group. The substituent group includes a hydroxyl group and a halogen atom. Specific examples of $X^-$ include those described above. The styrene-based polymerizable units are preferably those having a substituent group at the para-position.

(3)

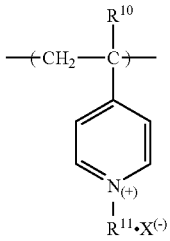

wherein $R^{10}$ represents a hydrogen atom or a methyl group, $R^{11}$ represents a hydrogen atom or a C1 to C22 alkyl group, and $X^-$ has the same meaning as defined above.

$R^{11}$ is preferably a C1 to C12, more preferably C1 to C3, alkyl group such as a methyl group, ethyl group, i-propyl group and n-propyl group, among which a methyl group is particularly preferable. Specific examples of $X^-$ include those described above.

(4)

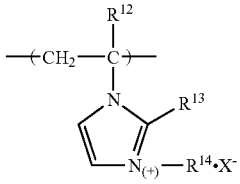

wherein $R^{12}$ represents a hydrogen atom or a methyl group, $R^{13}$ represents a hydrogen atom or a C1 to C3 alkyl group, $R^{14}$ represents a hydrogen atom or a C1 to C22 alkyl group, and $X^-$ has the same meaning as defined above.

$R^{13}$ is preferably a hydrogen atom or a methyl group, particularly preferably a hydrogen atom. $R^{14}$ is preferably a C1 to C12, more preferably C1 to C3, alkyl group such as a methyl group, ethyl group, i-propyl group and n-propyl group, among which a methyl group is particularly preferable. Specific examples of $X^-$ include those described above.

(5)

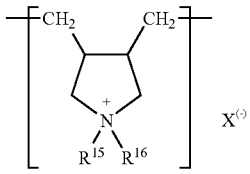

wherein $R^{15}$ and $R^{16}$ may be the same or different and each represent a hydrogen atom or a C1 to C3 alkyl group, and $X^-$ has the same meaning as defined above.

Preferably $R^{15}$ and $R^{16}$ are the same or different and include a hydrogen atom, methyl group, ethyl group, i-propyl group, n-propyl group etc. Specific examples of $X^-$ include those described above.

The synthetic cationic polymer in the present invention is preferably a copolymer containing nonionic polymerizable units. The nonionic polymerizable units are preferably hydrophilic nonionic polymerizable units. The hydrophilic polymerizable units refer to polymerizable units given by groups wherein the ratio of inorganic monomer (I) to organic monomer (O) [I/O] is 0.60 or more, preferably 1.00 or more, still more preferably 1.30 or more in Yuuki-GainenZu, (Organic Conceptual View)—basic and application—(authored by Yoshio Koda and published in May 10, 1984 by Sankyo Shuppan).

The nonionic polymerizable units can be obtained by copolymerization with nonionic monomers. Examples of such nonionic monomers include vinyl alcohol; (meth)acrylate or (meth)acrylamide having a hydroxyalkyl (C1 to C8) group, such as N-hydroxypropyl(meth)acrylamide, hydroxyethyl (meth)acrylate and N-hydroxypropyl(meth)acrylamide; polyvalent alcohol(meth)acrylates such as polyethylene glycol(meth)acrylate (degree of polymerization of ethylene glycol: 1 to 30); (meth)acrylamides; alkyl (C1 to C8) (meth) acrylamides such as N-methyl(meth)acrylamide, N-n-propyl (meth)acrylamide, N-isopropyl(meth)acrylamide, N-t-butyl (meth)acrylamide and N-isobutyl(meth)acrylamide; dialkyl (total number of carbon atoms: 2 to 8) (meth)acrylamides such as N,N-dimethyl(meth)acrylamide and N,N-diethyl (meth)acrylamide; diacetone(meth)acrylamide; N-vinyl cyclic amides such as N-vinyl pyrrolidone; (meth)acrylates having aralkyl (C1 to C8) group, such as methyl(meth)acrylate, ethyl(meth)acrylate and n-butyl(meth)acrylate; and (meth)acrylamides having a cyclic amide group, such as N-(meth)acryloyl morpholine.

The synthetic cationic polymer preferably has the nonionic polymerizable units so as to attain a nitrogen content in the range described above.

In the present invention, the synthetic cationic polymer can be synthesized according to the following known synthesis method 1 or 2:

Synthesis method 1. A method that involves polymerizing monomers represented by the following general formulae (6), (7), (8), (9) and (10) and then neutralizing the product with an acid or quaternarizing it with a quaternarizing agent.

Synthesis method 2. A method that involves neutralizing monomers represented by the following general formulae (6), (7), (8), (9) and (10) with an acid or quaternarizing the monomers with a quaternarizing agent and then polymerizing them.

(6)

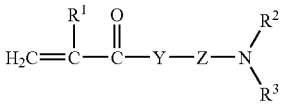

wherein $R^1$, $R^2$, $R^3$, Y and Z have the same meaning as defined above.

(7)

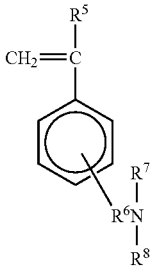

wherein $R^5$, $R^6$, $R^7$ and $R^8$ have the same meaning as defined above.

(8)

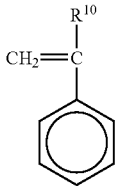

(8)

wherein $R^{10}$ has the same meaning as defined above.

(9)

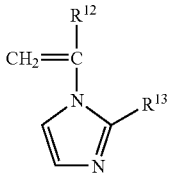

wherein $R^{12}$ and $R^{13}$ have the same meaning as defined above.

$$(CH_2{=}CHCH_2)_2NR^{15} \quad (10)$$

wherein $R^{15}$ has the same meaning as defined above.

In the synthesis methods 1 and 2, polymerization of the monomers can be carried out by a known radical polymerization method, for example a solution polymerization method.

The polymerization initiator includes, for example, peroxides such as sodium peroxide and azo compounds such as 2,2'-azobis(2-amidinopropane)hydrochloride. The solvent is preferably water or an alcohol such as methanol, ethanol or isopropanol.

Although the reaction temperature and reaction time are determined suitably depending on the monomers, the reaction is carried out preferably for 3 to 15 hours at 50 to 100° C.

The regulation of the molecular weight can be carried out suitably by selecting polymerization conditions such as polymerization temperature, the type and amount of the polymerization initiator, the concentration of the monomers etc. It is preferable that in the synthetic cationic polymer used in the present invention, the nonionic monomers described above are copolymerized so as to attain the nitrogen content described above.

The acid preferable for obtaining the acid-neutralized product includes hydrochloric acid, sulfuric acid, nitric acid, acetic acid, formic acid, maleic acid, fumaric acid, citric acid, tartaric acid, adipic acid, sulfamic acid, toluenesulfonic acid, lactic acid, pyrrolidone-2-carboxylic acid and succinic acid, and the quaternarizing agent preferable for obtaining the quaternary ammonium salt includes alkyl halides such as methyl chloride, ethyl chloride, methyl bromide and methyl iodide and general alkylating agents such as dimethyl sulfate, diethyl sulfate and di-n-propyl sulfate.

For the purpose of improving polymerization stability and mechanical stability, a nonionic polymer may be used in combination with the cationic polymer in the present invention. The nonionic polymer is preferably a semi-synthetic water-soluble polymer such as methyl cellulose, hydroxyethyl cellulose, soluble starch or the like, or a synthetic water-soluble polymer such as polyvinyl alcohol, obtained by polymerizing the nonionic monomers described above. The amount of the nonionic polymer used is preferably 0 to 100 parts by weight, more preferably 0 to 50 parts by weight, based on 100 parts by weight of the total vinyl monomers.

<Polymer Particles (B)>

The polymer particles (B) used in the present invention have a glass transition temperature (Tg) of preferably 90° C. or less, more preferably 80° C. or less. In respect of the performance of improving stiffness, a polymer Tg of 90° C. or less is preferable because a part or the whole of the paper quality improver for internal addition, contained in paper, is melted in a process of producing paper. The lower limit is not particularly limited, but is preferably −10° C. or more. When the cationic polymer is particularly a synthetic polymer, the Tg is preferably 90° C. or less.

The Tg of the copolymer can be calculated on the basis of 2.4. Formula of Copolymer Glass Transition in "Physical Properties of Polymers" (in Japanese) (Kagaku Dojin Shuppan, 1969). The Tg used is a value described in POLYMER HANDBOOK, Fourth Edition 1999 by John Wiley & Sons, Inc.

$$1/Tg=\Sigma Wn/Tgn$$

wherein Tg is the glass transition temperature of a copolymer, Tgn is the glass transition temperature of a homopolymer, and Wn is weight fraction.

The polymer particles used in the present invention contain vinyl monomer-derived structural units. The content of the constituent vinyl monomers in the polymer particles is not particularly limited, but is preferably 50 to 100 mol %, particularly preferably 80 to 100 mol %. The vinyl monomers include vinyl compounds, vinylene compounds, vinylidene compounds and cyclic olefins, and preferable examples include the following compounds:

(1) Alkyl (meth)acrylates having preferably a C1 to C12, more preferably C1 to C4 alkyl group ((meth)acrylates refer to hereinafter as acrylates, methacrylates or mixtures thereof), such as methyl(meth)acrylate, ethyl(meth)acrylate, isopropyl(meth)acrylate, butyl(meth)acrylate, isobutyl (meth)acrylate and t-butyl(meth)acrylate;

(2) Vinyl fatty esters consisting of vinyl alcohol and a C1 to C18, preferably C1 to C6, linear or branched fatty acid, such as vinyl acetate, vinyl propionate, vinyl butyrate and vinyl pivalate;

(3) Anionic monomers having a polymerizable unsaturated group, such as (meth)acrylic acid, maleic acid, fumaric acid, crotonic acid, itaconic acid, 2-(meth)acryloylethanesulfonic acid, 2-(meth)acryloylpropanesulfonic acid, 2-(meth)acrylamide-2-methylpropanesulfonic acid, vinylsulfonic acid and styrenesulfonic acid, or salts thereof, can be mentioned. Polycarboxylic acids such as maleic acid, fumaric acid and itaconic acid include acid anhydrides, partial esters, partial amides, and mixtures thereof. The "salts" include, for example, alkali metal salts (sodium salt, potassium salt, lithium salt etc.), alkaline earth metal salts (calcium salt, magnesium salt, barium salt etc.), ammonium salts (quaternary ammonium salt, quaternary alkyl ammonium salt etc.) etc. In particular, the sodium salt is most inexpensive and preferable.

(4) Nonionic hydrophilic group-containing monomers having a polymerizable unsaturated group, such as (meth)acrylamide, N-methyl(meth)acrylamide, N-ethyl(meth)acrylamide, N-isopropyl(meth)acrylamide, N,N-dimethyl(meth)acrylamide, N,N-diethyl(meth)acrylamide, 2-hydroxyethyl (meth)acrylate, 2-hydroxypropyl(meth)acrylate, methoxy polyethylene glycol(meth)acrylate, polyethylene glycol (meth)acrylate, N-vinyl pyrrolidone and N-vinyl acetamide can be mentioned.

(5) Amino group-containing monomers having a polymerizable unsaturated group, such as N,N-dimethylaminoethyl (meth)acrylate, N,N-dimethylaminopropyl(meth)acrylate and N,N-dimethylaminopropyl(meth)acrylamide, acid-neutralized products thereof or quaternary products thereof, can be specifically mentioned. The acid preferable for obtaining the acid-neutralized product includes hydrochloric acid, sulfuric acid, nitric acid, acetic acid, formic acid, maleic acid, fumaric acid, citric acid, tartaric acid, adipic acid and lactic acid, and the quaternarizing agent includes alkyl halides such as methyl chloride, ethyl chloride, methyl bromide and methyl iodide and general alkylating agents such as dimethyl sulfate, diethyl sulfate and di-n-propyl sulfate.

(6) Styrene and α-methyl styrene

Among the vinyl monomers described above, vinyl lower fatty esters are used most preferably to improve the stiffness of paper. The method of producing the polymer particles used in the present invention can be carried out by emulsion polymerization, suspension polymerization or dispersion polymerization.

(Polymer Emulsion)

The emulsion in the present invention contains the polymer particles (B) in an amount (in terms of solid content) of preferably 5 to 60 wt % or 10 to 60 wt %, more preferably 15 to 55 wt %, from the viewpoint of easiness of handling. From the viewpoint of emulsion stability, adsorption onto pulp etc., the average particle diameter of the polymer particles (B) is preferably 0.01 to 50 μm, more preferably 0.1 to 30 μm, still more preferably 0.2 to 20 μm. The solid content is measured by a method described in the Examples.

In the paper quality improver of the present invention, the amount of the natural cationic polymer (A) or synthetic cationic polymer (A') in the emulsion is preferably 5 to 200 parts by weight, more preferably 5 to 150 parts by weight and still more preferably 7 to 120 parts by weight, relative to 100 parts by weight of the polymer particles (B), to improve the polymerization stability of the polymer particles (B), to allow the polymer particles (B) to be effectively adsorbed onto pulp, and to improve the stiffness of a pulp sheet. In this amount, the weight of the polymer particles (B) is the total weight of the whole monomers constituting the polymer.

The amount of the natural cationic polymer (A) or synthetic cationic polymer (A') is preferably 5 to 500 parts by weight, more preferably 7 to 500 parts by weight and still more preferably 10 to 500 parts by weight, relative to 100 parts by weight of the polymer particles (B), to allow the polymer particles (B) to be effectively adsorbed on to pulp and to attain the auxiliary effect of the natural cationic polymer (A) or synthetic cationic polymer (A') on improvement of stiffness.

The emulsion in the present invention contains a dispersing medium in an amount of preferably 40 to 90 wt %, more preferably 45 to 85 wt %. The dispersing medium is preferably water which may contain a C1 to C4 lower alcohol. The lower alcohol includes a C1 to C3 methyl, ethyl and isopropyl alcohols.

The amount of the natural cationic polymer (A) or synthetic cationic polymer (A') is preferably 5 to 500 parts by weight, more preferably 7 to 500 parts by weight and still more preferably 30 to 500 parts by weight, relative to 100 parts by weight of the polymer particles (B), in order to attain the auxiliary effect of the natural cationic polymer (A) or synthetic cationic polymer (A') on improvement of stiffness.

Fillers and pigments such as calcium carbonate, talc and white carbon may be contained as additives in addition to a preservative, a sterilizer etc.

(Production of the Paper Quality Improver for Internal Addition)

An emulsion (suspension, aqueous dispersion) of the polymer particles (B) obtained by polymerizing the vinyl monomers is used in the paper quality improver for internal addition according to the present invention.

The method of polymerizing the polymer particles (B) is preferably an emulsion polymerization method, suspension polymerization method or dispersion polymerization method wherein a general anionic, cationic, nonionic or amphoteric surfactant, a natural, semi-synthetic or synthetic anionic or nonionic polymer or the above cationic polymer is used as a dispersion or emulsion stabilizer.

For example, mention is made of anionic surfactants such as sodium polyoxyethylene dodecyl ether sulfate and sodium dodecyl ether sulfate; cationic and amphoteric surfactants such as trimethyl stearyl ammonium chloride and carboxymethyl dimethyl cetyl ammonium; nonionic surfactants, for example sucrose fatty esters such as sucrose monostearate and sucrose dilaurate, sorbitan esters such as sorbitan monostearate, a polyoxyalkylene adduct to sorbitan ester such as polyoxyethylene sorbitan monostearate, and a polyoxyalkylene adduct to an aliphatic alcohol; natural and semi-synthetic polymers such as starch and derivatives thereof, cellulose ethers such as ethyl cellulose, cellulose esters such as cellulose acetate, and cellulose derivatives; and synthetic polymers such as polyvinyl alcohol and derivatives thereof, and maleated polybutadiene.

Preferable among these compounds are compounds produced by polymerizing vinyl monomers in the presence of the natural cationic polymer (A) or synthetic cationic polymer (A') by the emulsion polymerization method, suspension polymerization method or dispersion polymerization method, particularly preferably by the emulsion polymerization method.

The vinyl polymers are used in an amount of preferably 1 to 70 parts by weight, more preferably 1.5 to 60 parts by weight, still more preferably 8 to 57 parts by weight, relative to 100 parts by weight of the reaction solvent. The reaction solvent is preferably water or a lower alcohol.

The polymerization initiator used includes peroxides dissolved uniformly in solvent, organic or inorganic acids or salts thereof, azobis compounds, or redox initiators having the above initiators combined with reducing agents. Typical examples include t-butyl peroxide, t-amyl peroxide, cumyl peroxide, acetyl peroxide, propionyl peroxide, benzoyl peroxide, benzoyl isobutyryl peroxide, lauroyl peroxide, t-butyl hydroperoxide, cyclohexyl hydroperoxide, tetralin hydroperoxide, t-butyl peracetate, t-butyl perbenzoate, bis(2-ethylhexyl peroxy dicarbonate), 2,2'-azobisisobutyronitrile, phenyl azotriphenyl methane, 2,2'-azobis(2-amidinopropane) dihydrochloride, 2,2'-azobis[2-(5-methyl-2-imidazolin-2-yl) propane]dihydrochloride, 2,2'-azobis[2-(2-imidazolin-2-yl) propane]dihydrochloride, sodium persulfate, potassium persulfate, ammonium persulfate, hydrogen peroxide, and combinations of persulfate and tertiary amine such as triethylamine, triethanolamine or dimethyl aniline. The amount of the polymerization initiator used is varied depending on the system used, but is preferably 0.05 to 3 parts by weight relative to 100 parts by weight of the vinyl monomers.

The reaction temperature is preferably 30 to 90° C., and the reaction time is preferably about 30 minutes to 10 hours.

After the reaction is finished, the emulsion can be used directly as the paper quality improver for internal addition in the present invention.

When a dispersion or emulsion stabilizer other than the natural cationic polymer (A) or synthetic cationic polymer (A') is used, the natural cationic polymer (A) or synthetic cationic polymer (A') is added to, and mixed with, the emulsion preferably at room temperature after polymerization. Even when the natural cationic polymer (A) or synthetic cationic polymer (A') is used as a dispersant or an emulsion stabilizer, the natural cationic polymer (A) or synthetic cationic polymer (A') may be further added to the emulsion after polymerization.

In the present invention, an additive such as a pH adjusting agent may be used at the time of polymerization in order to improve polymerization stability, mechanical stability, storage stability etc. As the pH adjusting agent, an acid such as phosphoric acid, tartaric acid or the like or an aqueous solution of an alkali such as sodium hydroxide, potassium hydroxide or the like is added to the polymerization system.

(Method of Improving Paper Qualities)

In the present invention, the emulsion is mixed with pulp preferably at room temperature and used in paper making to give a pulp sheet wherein the paper quality improver for internal addition is contained in the surface and/or the inside of the pulp sheet. Alternatively, an emulsion containing the polymer particles (B), and the natural cationic polymer (A) or synthetic cationic polymer (A'), are added separately to pulp and used in paper making to give a pulp sheet wherein the paper quality improver for internal addition according to the present invention is contained in the surface and/or the inside of the pulp sheet.

The amount of the paper quality improver for internal addition, in terms of solid content, is preferably 0.05 to 20 parts by weight, more preferably 0.1 to 10 parts by weight, relative to 100 parts by weight of pulp. From the viewpoint of performance of improving stiffness and bulk, the amount of the paper quality improver for internal addition is preferably 0.05 part by weight or more, and from the viewpoint of performance inherent in the pulp sheet, the amount is preferably 20 parts by weight or less.

When the paper quality improver for internal addition is used in an amount of 0.5 to 1.0 part by weight relative to 100 parts by weight of pulp, the stiffness, as determined by a measurement method described later, is made higher preferably by 1%, more preferably by at least 2.5%, than that of a pulp sheet as a control to which the paper quality improver for internal addition was not added.

The "internal addition" in the present invention means that the improver is used as an agent added to pulp slurry in a process of producing a pulp sheet, that is, at the time of papermaking. The place where the improver is added may be a pulping machine or a beater such as a pulper or a refiner, a tank in a machine chest, a head box or a white-water tank, or a piping connected to such facilities, desirably a refiner, a machine chest or a head box where the improver can be mixed uniformly with the pulp material, prior to the paper-making process wherein a filtrated water of the pulp material, while passing on a wire mesh, drains water out to form a paper layer.

The pulp sheet obtained by using the paper quality improver for internal addition according to the present invention is used preferably in newspapers, uncoated printing paper, lightly coated printing paper, coated printing paper, information paper, corrugated cardboard paper and white plate paper.

The paper quality improver for internal addition, which comprises an emulsion containing the natural cationic polymer (A) having cationic groups or the synthetic cationic polymer (A') and the polymer particles (B) having at least vinyl monomer-derived structural units, can be added in paper making to give a pulp sheet having high stiffness and/or bulk, particularly a pulp sheet having high stiffness.

EXAMPLES

Hereinafter, the terms "%" and "parts" in the Production Examples and Examples refer to % by weight and parts by weight respectively unless otherwise specified.

<Production Examples of Emulsions>

Emulsion I

A 2-L flask equipped with a ref lux condenser, a dropping funnel, a thermometer, a nitrogen inlet and a stirrer was charged with 48.2 g cationic starch A [N %=0.6%; the viscosity of 7% aqueous solution, 260 mPa·s (50° C., Brookfield viscometer, Rotor No. 2, 60 rpm)] and 695.0 g ion exchange water, and the mixture was dissolved by heating at 90° C. After cooling, 29.3 g EMULGEN 150 (nonionic surfactant, 20% aqueous solution, manufactured by Kao Corporation), and an aqueous solution having 1.9 g of 75% aqueous phosphoric acid and 45.0 g of 4% sodium hydroxide mixed with 17.2 g ion exchange water, were added thereto, stirred at 120 rpm and heated at 60° C. for 30 minutes while nitrogen was blown into the reaction mixture. Then, 20.4 g vinyl acetate (manufactured by Shin-Etsu Sakusan Vinyl Co., Ltd.) and a solution of 1.1 g initiator (V-50, azo-based initiator, manufactured by Wako Pure Chemical Industries, Ltd.) in 29.6 g ion exchange water were added thereto and kept for 15 minutes. Then, the mixture was heated to 77° C., and a mixture of 409.3 g vinyl acetate and 11.0 g methacrylic acid (manufactured by Mitsubishi Rayon Co., Ltd.) and a solution of 0.9 g initiator (V-50) in 210 g ion exchange water were added dropped thereto over 3 hours through separate dropping funnels respectively, and the mixture was polymerized. Then, the reaction mixture was heated to 82° C., aged for 1 hour, cooled and recovered.

Cationic Emulsion I having a solid content of 30.8% and an average particle diameter of 2.63 μm was obtained.

Emulsion II

According to the method of producing Emulsion I, the same apparatus was charged with 48.2 g cationic starch A [N %=0.6%; the viscosity of 7% aqueous solution, 260 mPa·s (50° C., Brookfield viscometer, Rotor No. 2, 60 rpm)], 8.1 g polyvinyl alcohol (GL-05, polymerization degree of 500, saponification degree of 88 mol %, manufactured by The Nippon Synthetic Chemical Industry Co., Ltd.) and 585.2 g ion exchange water, and the mixture was dissolved by heating at 90° C. After cooling, 29.3 g EMULGEN 150 (nonionic surfactant, 20% aqueous solution, manufactured by Kao Corporation), and an aqueous solution having 1.9 g of 75% aqueous phosphoric acid and 45.0 g of 4% sodium hydroxide mixed with 17.2 g ion exchange water, were added thereto, stirred at 120 rpm and heated at 60° C. for 30 minutes while nitrogen was blown into the reaction mixture. Then, 20.4 g vinyl acetate (manufactured by Shin-Etsu Sakusan Vinyl Co., Ltd.) and a solution of 1.1 g initiator (V-50, azo-based initiator, manufactured by Wako Pure Chemical Industries, Ltd.) in 29.6 g ion exchange water were added thereto and kept for 15 minutes. Then, the mixture was heated to 77° C., and a mixture of 205.0 g vinyl acetate, 5.5 g methacrylic acid (manufactured by Mitsubishi Rayon Co., Ltd.) and 6.6 g dimethyl acrylamide (reagent, manufactured by Wako Pure Chemical Industries), and a solution of 0.35 g initiator (V-50) in 101 g ion exchange water, were added dropped thereto over 3 hours through separate dropping funnels respectively, and the mixture was polymerized. Then, the reaction mixture was heated to 82° C., aged for 1 hour, cooled and recovered.

Cationic Emulsion II having a solid content of 23.5% and an average particle diameter of 0.52 μm was obtained.

Emulsions III to XIII and XV to XVII

These emulsions were synthesized in the same manner as for Emulsion II except that the cationic polymer and the monomer composition of polymer particles (B) were changed as shown in Tables 1 and 2 (The polyvinyl alcohol was used in a ratio of 16.8 parts by weight to 100 parts by weight of the cationic polymer. The amount of ion exchange water was suitably changed.)

Emulsion XIV

The emulsion was synthesized in the same manner as in the polymerization method and monomer composition of Emulsion II except that the cationic polymer was not used. Emulsion XIV having a solid content of 17.7% and an average particle diameter of 1.85 μm was obtained.

Emulsion XVIII

According to the method of producing Emulsion I, the same apparatus was charged with 28.9 g cationic starch A [N %= 0.6%; the viscosity of 7% aqueous solution, 260 mPa·s (50° C., Brookfield viscometer, Rotor No. 2, 60 rpm)], 4.8 g polyvinyl alcohol (GL-05, polymerization degree of 500, saponification degree of 88 mol %, manufactured by The Nippon Synthetic Chemical Industry Co., Ltd.) and 539.7 g ion exchange water, and the mixture was dissolved by heating at 90° C. After cooling, 21.3 g EMULGEN 150 (nonionic surfactant, 20% aqueous solution, manufactured by Kao Corporation), and an aqueous solution having 1.1 g of 75% aqueous phosphoric acid and 26.6 g of 4% sodium hydroxide mixed with 10.2 g ion exchange water, were added thereto, stirred at 120 rpm and heated at 60° C. for 30 minutes while nitrogen was blown into the reaction mixture. Then, 10.7 g vinyl acetate (manufactured by Shin-Etsu Sakusan Vinyl Co., Ltd.) and a solution of 1.0 g initiator (V-50, azo-based initiator, manufactured by Wako Pure Chemical Industries, Ltd.) in 9.0 g ion exchange water were added thereto and kept for 15 minutes. Then, the mixture was heated to 77° C., aged for 1 hour, cooled and recovered.

Cationic Emulsion XVIII having a solid content of 7.9% and an average particle diameter of 0.20 μm was obtained.

Emulsion XIX

According to the method of producing Emulsion I, the same apparatus was charged with 28.9 g cationic starch A [N %=0.6%; the viscosity of 7% aqueous solution, 260 mPa·s (50° C., Brookfield viscometer, Rotor No. 2, 60 rpm)], 4.8 g polyvinyl alcohol (GL-05, polymerization degree of 500, saponification degree of 88 mol %, manufactured by The Nippon Synthetic Chemical Industry Co., Ltd.) and 539.7 g ion exchange water, and the mixture was dissolved by heating at 90° C. After cooling, 21.3 g EMULGEN 150 (nonionic surfactant, 20% aqueous solution, manufactured by Kao Corporation), and an aqueous solution having 1.1 g of 75% aqueous phosphoric acid and 26.6 g of 4% sodium hydroxide mixed with 10.2 g ion exchange water, were added thereto, stirred at 120 rpm and heated at 60° C. for 30 minutes while nitrogen was blown into the reaction mixture. Then, 10.7 g vinyl acetate (manufactured by Shin-Etsu Sakusan Vinyl Co., Ltd.) and a solution of 1.0 g initiator (V-50, azo-based initiator, manufactured by Wako Pure Chemical Industries, Ltd.) in 9.0 g ion exchange water were added thereto and kept for 15 minutes. Then, the mixture was heated to 77° C., and a mixture of 54.3 g vinyl acetate, 1.6 g methacrylic acid (manufactured by Mitsubishi Rayon Co., Ltd.) and 1.9 g dimethyl acrylamide (reagent, manufactured by Wako Pure Chemical Industries), and a solution of 0.85 g initiator (V-50) in 130 g ion exchange water, were added dropped thereto over 3 hours through separate dropping funnels respectively, and the mixture was polymerized. Then, the reaction mixture was heated to 82° C., aged for 1 hour, cooled and recovered.

Cationic Emulsion XIX having a solid content of 13.1% and an average particle diameter of 0.43 μm was obtained.

Emulsion II-I

A 2-L flask equipped with a reflux condenser, a dropping funnel, a thermometer, a nitrogen inlet and a stirrer was charged with 70 g cationic polyvinyl alcohol [PVA C-118 manufactured by Kuraray Co., Ltd.; N %=0.3%; the viscosity aqueous solution, 67 mPa·s (50° C., Brookfield viscometer, Rotor No. 1, 60 rpm)] and 570 g ion exchange water, and the polyvinyl alcohol was dissolved by heating at 90° C. After cooling, 30 g EMULGEN 150 (nonionic surfactant, 20% aqueous solution, manufactured by Kao Corporation) and 11.4 g of 4% tartaric acid (reagent, manufactured by Wako Pure Chemical Industries) were added thereto (after this addition, the pH of the whole system was 4.0), then stirred at 120 rpm and heated at 60° C. for 30 minutes while nitrogen was blown into the reaction mixture. Then, 20 g vinyl acetate (manufactured by Shin-Etsu Sakusan Vinyl Co., Ltd.), and a solution of 0.2 g initiator (V-50, azo-based initiator, manufactured by Wako Pure Chemical Industries, Ltd.) in 10 g ion exchange water, were added thereto and kept for 15 minutes. Then, the mixture was heated to 75° C., and 380 g vinyl acetate and a solution of 0.8 g initiator (V-50) in 160 g ion exchange water were dropped thereto over 3 hours through separate dropping funnels respectively, and the mixture was polymerized. Then, the reaction mixture was heated to 82° C., aged for 1 hour, cooled and recovered.

Cationic Emulsion II-I having a solid content of 36.3% and an average particle diameter of 5.68 μm was obtained.

Emulsion II-II

The emulsion was synthesized in the same manner as in the method of producing Emulsion II-I except that vinyl acetate/methacrylic acid/dimethyl acrylamide (94.9/2.32/2.78 [ratio by weight]) was used in place of vinyl acetate, and the cationic polyvinyl alcohol was not used (The amount of ion exchange water was suitably changed). Emulsion II-II had a solid content of 17.7% and an average particle diameter of 1.85 μm.

Emulsion II-III

The emulsion was synthesized in the same manner as in the method of producing Emulsion II-I except that polyvinyl alcohol having a mercapto group at the terminus thereof (PVA M-115, N %=0%, polymerization degree 1500, manufactured by Kuraray Co., Ltd.) was used in place of the cationic polyvinyl alcohol, and styrene/methacrylate hydroxypropyl trimethyl ammonium chloride (95/5 [ratio by weight]) was used in place of vinyl acetate (The amount of ion exchange water was suitably changed). Emulsion II-III had a solid content of 32% and an average particle diameter of 5.52 μm.

Emulsion III-I

The emulsion was synthesized in the same manner as in the polymerization method and monomer composition of Emulsion XVIII except that 468.0 g ion exchange water and 175.8 g EMULGEN 150 were used. Emulsion III-I having a solid content of 19.5% and an average particle diameter of 0.22 μm was obtained.

Emulsion III-II

The emulsion was synthesized in the same manner as in the polymerization method and monomer composition of Emulsion XVIII except that ion exchange water was used in an amount of 556.8 g, and 35.2 g polyoxyethylene (50) stearyl ether was used in place of EMULGEN 150. Emulsion III-II having a solid content of 20.7% and an average particle diameter of 0.23 μm was obtained.

<Method of Measuring Physical Properties>

(1) Solid Content

The solid content of the emulsion was determined by measuring 1 g sample under heating at 150° C. for 20 minutes with an infrared moisture determination balance FD-240 (Kett).

(2) Method of Measuring the Average-Particle Diameter

The average particle diameter of dispersed particles in the emulsion was measured by laser diffraction/scattering particle size distribution measuring instrument LA-910 (manufactured by Horiba, Ltd.). The average particle diameter was expressed in terms of median diameter. By this measurement method, particles of less than 0.4 μm were measured with a dynamic light scattering particle diameter distribution measuring instrument N4 Plus (Beckman Coulter, Inc.). In this case, the average particle diameter was determined by a unimodal method (cumulant method).

(3) Method of Measuring a Nitrogen Content

The nitrogen content of the cationic polymer was determined according to the JIS K 8001 method.

(4) Method of Measuring Viscosity

The viscosity (7 wt %) of the cationic polymer was measured by a Brookfield viscometer (60 rpm, 50° C.). The rotor was selected suitably according to viscosity to be measured.

Examples 1 to 28

A paper quality improver (also referred to hereinafter as agent) consisting of the above emulsion was used in manufacturing paper from the following pulp material, and the resulting pulp sheet was evaluated for improvement of stiffness and bulk. The results are shown in Tables 1 and 2.

[Pulp Material]

As the pulp material, LBKP (broad-leaved bleached kraft pulp) was pulped and beaten at 25° C. by a beater to give 1% LBKP slurry as virgin pulp. The Canadian Standard Freeness (JIS P 8121) of this product was 410 ml.

[Papermaking Method]

The virgin pulp slurry was weighed such that the pulp basis weight of a pulp sheet after papermaking became 70 g/m$^2$±1 g/m$^2$, and as shown in Table 1, each of the paper quality improvers for internal addition in the Examples of the present invention or in the Comparative Examples was added as an internal agent in an amount of 0.5 to 5% [that is, the total amount of the natural cationic polymer (A) or synthetic cationic polymer (A') and polymer particles (B)] per 100 parts by weight of pulp, and then used in papermaking by a square TAPPI paper machine with a 80-mesh wire (area 625 cm$^2$) to give a pulp sheet. The sheet after papermaking was pressed for 5 minutes at 3.5 kg/cm$^2$ with a pressing machine and dried at 105° C. for 2 minutes with a mirror-surface dryer. The dried pulp sheet was subjected to moisture conditioning under the conditions of 23° C. and 50% humidity for 1 day, and the paper was measured for bulk density and Clark stiffness in the following methods. The number of paper samples was 5 for each improver, and the average of 10 paper measurements for each improver was determined.

[Evaluation Items/Methods]

Improvement Ratio of Stiffness

The paper to which the paper quality improver was added and additive-free paper were examined for Clark stiffness (according to JIS P8143 method) and calculated according to the equation below. The results are shown in Tables 1 and 2. In the Examples, the stiffness was improved by 7.6% or more and 2.6% or more when the amounts of the internally added agent was 5% and 0.5% respectively, while in the Comparative Examples, the stiffness was improved by 4.8% or less and 1.6% or less when the amounts of the internally added agent was 5% and 0.5% respectively.

improvement ratio of stiffness (%)=(Clark stiffness of the paper having the improver internally added thereto/Clark stiffness of the additive-free paper−1)×100

Improvement Ratio of Bulk

The bulk density (according to JIS P8118) of each of the paper having the paper quality improver internally added thereto and the additive-free paper was determined, and the improvement ratio of bulk was determined according to the following equation:

improvement ratio of bulk=(1/bulk density of the paper having the improver internally added thereto−1/bulk density of the additive-free paper)/(1/bulk density of the additive-free paper)×100

TABLE 1

| | Cationic polymer (A) | | | Polymer particle (B) Monomer composition[2] (%) | | | | | Emulsion | | | | Performance of manufactured paper | | |
|---|---|---|---|---|---|---|---|---|---|---|---|---|---|---|---|
| Example | Kind[1] | N % (%) | Viscosity (mPa · s) | Monomer (1) | Monomer (2) | Monomer (3) | Monomer (4) | Tg (° C.) | No. | Addition amount of (A)[3] (%) | Solid content (%) | Average particle diameter (μm) | Amount of internally added agent (%) | improvement ratio of stiffness (%) | improvement ratio of bulk (%) |
| 1 | cationic starch A | 0.6 | 260 | VAc 98.79 | MAA 1.21 | — | — | 33 | I | 11 | 30.8 | 2.63 | 5.0 | 13.1 | 3.35 |
| 2 | cationic starch A | 0.6 | 260 | VAc 94.9 | MAA 2.32 | DMAAm 2.78 | — | 36 | II | 20 | 23.5 | 0.52 | 0.5 | 5.1 | 3.13 |
| 3 | cationic starch A | 0.6 | 260 | VAc 94.9 | MAA 2.32 | MDAAm 2.78 | — | 36 | II | 20 | 23.5 | 0.52 | 5.0 | 8.6 | 3.97 |
| 4 | Cationic HEC | 0.4 | 2210 | St 65 | MAA 1.21 | BMA 33.79 | — | 69 | XI | 20 | 24.3 | 1.63 | 0.5 | 5.2 | 3.64 |
| 5 | Cationic HEC | 0.4 | 2210 | St 65 | MAA 1.21 | BMA 33.79 | — | 69 | XI | 20 | 24.3 | 1.63 | 1.0 | 7.9 | 4.76 |
| 6 | cationic starch A | 0.6 | 260 | VAc 49.58 | MAA 2.43 | DMAAm 2.91 | vinyl pivalate 45.08 | 59 | IX | 20 | 33.3 | 1.45 | 0.5 | 4.9 | 3.64 |
| 7 | cationic starch A | 0.6 | 260 | VAc 49.58 | MAA 2.43 | DMAAm 2.91 | vinyl pivalate 45.08 | 59 | IX | 20 | 33.3 | 1.45 | 5.0 | 12.2 | 2.45 |
| 8 | Cationic cellulose | 0.5 | 1280 | MMA 70 | MAA 1.21 | BA 28.79 | — | 40 | I | 20 | 23.3 | 1.72 | 0.5 | 5.0 | 3.45 |
| 9 | Cationic cellulose | 0.5 | 1280 | MMA 70 | MAA 1.21 | BA 28.79 | — | 40 | I | 20 | 23.3 | 1.72 | 1.0 | 8.9 | 5.31 |
| 10 | cationic starch A | 0.6 | 260 | VAc 94.66 | MAA 1.21 | DMAAm 1.45 | — | 34 | X | 10 | 39.0 | 0.94 | 0.5 | 10.5 | 3.40 |
| 11 | cationic starch A | 0.6 | 260 | VAc 94.66 | MAA 1.21 | DMAAm 1.45 | — | 34 | X | 10 | 39.0 | 0.94 | 5.0 | 26.0 | 5.46 |
| 12 | cationic starch A | 0.6 | 260 | VAc 100 | — | — | — | 32 | XIII | 10 | 32.7 | 0.66 | 0.5 | 5.3 | 3.94 |
| 13 | cationic starch A | 0.6 | 260 | VAc 100 | — | — | — | 32 | XIII | 10 | 32.7 | 0.66 | 5.0 | 25.9 | 7.19 |
| 14 | ACE K-36 | 0.35 | 1130 | VAc 100 | — | — | — | 32 | V | 20 | 23.9 | 0.53 | 0.5 | 6.4 | 2.14 |
| 15 | ACE K-36 | 0.35 | 1130 | VAc 100 | — | — | — | 32 | V | 20 | 23.9 | 0.53 | 1.0 | 9.7 | 2.34 |
| 16 | ACE K-100 | 0.2 | 2500 | VAc 94.9 | MAA 2.32 | DMAAm 2.78 | — | 36 | IV | 20 | 20.5 | 12.7 | 0.5 | 3.2 | 1.76 |
| 17 | ACE K-100 | 0.2 | 2500 | VAc 94.9 | MAA 2.32 | DMAAm 2.78 | — | 36 | IV | 20 | 20.5 | 12.7 | 1.0 | 24.6 | 1.65 |
| 18 | cationic starch B | 0.8 | 2000 | VAc 94.9 | MAA 2.32 | DMAAm 2.78 | — | 36 | III | 20 | 23.3 | 0.52 | 5.0 | 8.5 | 5.47 |
| 19 | ACE K-250 | 0.2 | 52 | VAc 94.9 | MAA 2.32 | DMAAm 2.78 | — | 36 | VII | 102 | 22.0 | 19.4 | 0.5 | 2.6 | 5.38 |

TABLE 1-continued

| Example | Cationic polymer (A) Kind[1)] | N % (%) | Viscosity (mPa · s) | Polymer particle (B) Monomer composition[2)] (%) Monomer (1) | Monomer (2) | Monomer (3) | Monomer (4) | Tg (° C.) | Emulsion No. | Addition amount of (A)[3)] (%) | Solid content (%) | Average particle diameter (μm) | Performance of manufactured paper: Amount of internally added agent (%) | Improvement ratio of stiffness (%) | Improvement ratio of bulk (%) |
|---|---|---|---|---|---|---|---|---|---|---|---|---|---|---|---|
| 20 | ACE K-250 | 0.2 | 52 | VAc 94.9 | MAA 2.32 | DMAAm 2.78 | — | 36 | VII | 102 | 22.0 | 19.4 | 2.0 | 9.3 | 4.71 |

TABLE 2

| | Cationic polymer (A) Kind[1)] | N % (%) | Viscosity (mPa · s) | Polymer particle (B) Monomer composition[2)] (%) Monomer (1) | Monomer (2) | Monomer (3) | Tg (° C.) | Emulsion No. | Addition amount of (A)[3)] (%) | Solids content (%) | Average particle diameter (μM) | Performance of manufactured paper: Amount of internally added agent (%) | Improvement ratio of stiffness (%) | Improvement ratio of bulk (%) |
|---|---|---|---|---|---|---|---|---|---|---|---|---|---|---|
| Example | | | | | | | | | | | | | | |
| 21 | ACE K-500 | 0.2 | 4650 | VAc 94.9 | MAA 2.32 | DMAAm 2.78 | 36 | VI | 20 | 23.4 | 13.1 | 0.5 | 22.3 | 0.94 |
| 22 | ACE K-500 | 0.2 | 4650 | VAc 94.9 | MAA 2.32 | DMAAm 2.78 | 36 | VI | 20 | 23.4 | 13.1 | 1.0 | 12.6 | 1.67 |
| 23 | Cationic starch A | 0.6 | 260 | VAc 94.9 | MAA 2.32 | DMAAm 2.78 | 36 | VIII | 41 | 23.7 | 0.42 | 0.5 | 12.1 | 5.86 |
| 24 | Cationic starch A | 0.6 | 260 | VAc 94.9 | MAA 2.32 | DMAAm 2.78 | 36 | VIII | 41 | 23.7 | 0.42 | 5.0 | 7.8 | 6.32 |
| 25 | Cationic starch A | 0.6 | 260 | VAc 98.55 | DMAAm 1.45 | — | 33 | XII | 10 | 29.5 | 0.43 | 0.5 | 7.6 | 5.20 |
| 26 | Cationic starch A | 0.6 | 260 | Vac 98.55 | DMAAm 1.45 | — | 33 | XII | 10 | 29.5 | 0.43 | 5.0 | 9.1 | 6.90 |
| 27 | Cationic starch A | 0.6 | 260 | VAc 100 | — | — | 32 | XVIII | 315 | 7.9 | 0.20 | 4.0 | 11.8 | 4.9 |
| 28 | Cationic starch A | 0.6 | 260 | VAc 94.9 | MAA 2.32 | DMAAm 2.79 | 36 | XIX | 49 | 13.1 | 0.43 | 1.6 | 10.5 | 6.2 |
| Comparative example | | | | | | | | | | | | | | |
| 1 | No addition | — | — | VAc 94.9 | MAA 2.32 | DMAAm 2.78 | 33 | XIV | — | 17.7 | 1.85 | 5.0 | −2.4 | −0.06 |
| 2 | PVA-2 | 0.3 | 11 | VAc 99.13 | AA 0.87 | — | 33 | XV | 53.5 | 28.6 | 4.37 | 0.5 | 1.6 | 0.08 |
| 3 | PVA-2 | 0.3 | 11 | VAc 99.13 | AA 0.87 | — | 33 | XV | 53.5 | 28.6 | 4.37 | 5.0 | 4.8 | 1.34 |
| 4 | PVA-1 | — | 15 | St 95 | GMAC 5 | — | >100 | XVI | 10 | 41.5 | 4.35 | 0.5 | 0.7 | 0.71 |
| 5 | PVA-1 | — | 15 | St 95 | GMAC 5 | — | >100 | XVI | 10 | 41.5 | 4.35 | 1.0 | −9.4 | 0.1 |

TABLE 2-continued

| | Cationic polymer (A) | | | Polymer particle (B) | | | | Emulsion | | | | Performance of manufactured paper | | |
|---|---|---|---|---|---|---|---|---|---|---|---|---|---|---|
| | | | | Monomer composition[2] (%) | | | | | | | | | | |
| | Kind[1] | N % (%) | Viscosity (mPa · s) | Monomer (1) | Monomer (2) | Monomer (3) | Tg (° C.) | No. | Addition amount of (A)[3] (%) | Solids content (%) | Average particle diameter (μM) | Amount of internally added agent (%) | improvement ratio of stiffness (%) | improvement ratio of bulk (%) |
| 6 | PVA-1 | — | 15 | St 95 | GMAC 5 | — | >100 | XVII | 15 | 32.0 | 5.52 | 0.5 | −5.6 | 1.45 |
| 7 | PVA-1 | — | 15 | St 95 | GMAC 5 | — | >100 | XVII | 15 | 32.0 | 5.52 | 5.0 | −11.2 | 1.33 |

(Notes)
[1]Each cationic polymer is as follows:
Cationic HEC manufactured by Wako Pure Chemical Industries, Ltd.
Cationic cellulose manufactured by Wako Pure Chemical Industries, Ltd.
ACE K-36, K-100, K-250, K-500, which is cationic starch, manufactured by Oji Corn Starch, Ltd.
Cationic starch B: N % = 0.8%, the viscosity of 7% aqueous solution = 2000 mPa · s
PVA-1 (M-115, polymerization degree 1500), mercapto-modified polyvinyl alcohol, manufactured by Kuraray Co., Ltd.
PVA-2 (C-506, polymerization degree 600), mercapto-modified polyvinyl alcohol, manufactured by Kuraray Co., Ltd.
[2]Each monomer is as follows:
VAc: vinyl acetate
St: styrene
MAA: methacrylic acid
AA: acrylamide
GMAC: methacrylate hydroxypropyl methyl ammonium chloride
DMAAm: dimethyl acrylamide
MMA: methyl methacrylate
BMA: butyl methacrylate
BA: butyl acrylate
[3]The amount of (A) added is expressed in wt % relative to the vinyl monomer in the monomer composition of polymer particles (B).

Examples 29 to 30

The improvement of stiffness and bulk of paper produced from the following pulp material by using the paper quality improver shown in Table 3 was evaluated in the same manner as in Example 1. The results are shown in Table 3. The paper quality improver of the present invention can achieve the paper quality improvement effect even in a relatively small amount of the cationic polymer used.

TABLE 3

| | Cationic polymer (A') | | | Polymer particle (B) | | Emulsion | | | | Performance of manufactured paper | | |
|---|---|---|---|---|---|---|---|---|---|---|---|---|
| | Kind | Nitrogen content (%) | Viscosity (mPa · s) | Monomer composition[1] | Tg (° C.) | No. | Addition amount of[2] (A') (%) | Solids content (%) | Average particle diameter (μm) | Amount of internally added agent (%) | improvement ratio of stiffness (%) | improvement ratio of bulk (%) |
| Example | | 0 | | | | | | | | | | |
| 29 | PVA C-118 | 0.3 | 67 | Vinyl acetate 100% | 32 | II-I | 17.5 | 36.3 | 5.68 | 0.5 | 2.7 | 0.84 |
| 30 | PVA C-118 | 0.3 | 67 | Vinyl acetate 100% | 32 | II-I | 17.5 | 36.3 | 5.68 | 5 | 6.9 | 2.67 |
| Comparative example | | | | | | | | | | | | |
| 8 | — | — | — | Vinyl acetate 94.9% Methacrylic acid 2.32% DMAAm 2.78% | 36 | II-II | — | 17.7 | 1.85 | 5 | −2.4 | −0.06 |
| 9 | PVA M-115 | — | 15 | Styrene 95% GMAC 5% | | II-III | 15 | 32 | 5.52 | 0.5 | −5.6 | 1.45 |

TABLE 3-continued

| | Cationic polymer (A') | | | Polymer particle (B) | | Emulsion | | | | Performance of manufactured paper | | |
|---|---|---|---|---|---|---|---|---|---|---|---|---|
| | Kind | Nitrogen content (%) | Viscosity (mPa · s) | Monomer composition[1)] | Tg (° C.) | No. | Addition amount of[2)] (A') (%) | Solids content (%) | Average particle diameter (μm) | Amount of internally added agent (%) | improvement ratio of stiffness (%) | improvement ratio of bulk (%) |
| 10 | PVA M-115 | — | 15 | Styrene 95% GMAC 5% | | II-III | 15 | 32 | 5.52 | 5 | −11.2 | 1.33 |

(Notes)
[1)]DMAAm is dimethyl acrylamide, and GMAC is methacrylate hydroxypropyl methyl ammonium chloride.
[2)]The amount of internally added agent is expressed in wt % relative to the vinyl monomer in the monomer composition of the polymer particles.

It is estimated that even if Emulsions III-I and III-I are used, the improvement of stiffness and the improvement of bulk can be achieved to the same level as in Examples 1 to 30.

The invention claimed is:

1. A method of making paper comprising:

mixing a pulp slurry and a polymer emulsion comprising a cationic starch having a nitrogen content (N %) of 0.2 to 0.8 percent (A) and polymer particles (B) having an average particle diameter of 0.2 to 19.4 μm and comprising at least vinyl monomer-derived structural units comprising 94.66 wt. % to 100 wt. % of vinyl acetate units, wherein the polymer particles (B) are obtained by an emulsion polymerization method, suspension polymerization method or dispersion polymerization method in the presence of said cationic starch having a nitrogen content (N %) of 0.2 to 0.8 percent (A) to form a mixture, such that the proportion of (A) is from 10 to 315 parts by weight relative to 100 parts by weight of the polymer particles (B); wherein the polymer emulsion has a solid content of 7.9 to 39% by weight and wherein the glass transition temperature (TG) of (B) is from 32° C. to 59° C.;

filtering said mixture on a wire mesh to drain water out to form a paper layer, wherein said polymer emulsion is added to said pulp slurry at the time of papermaking, and wherein the emulsion polymerization method, suspension polymerization method or dispersion polymerization method is carried out in the presence of a surfactant.

2. A method of making paper comprising:

mixing a pulp shiny and a polymer emulsion comprising a cationic starch having a nitrogen content (N %) of 0.2 to 0.8 percent (A) having a viscosity of 20 mPa·s or more in a 7 wt. % aqueous solution as determined at 50° C. with a Brookfield viscometer and Rotor No. 2 at 60 rpm, and polymer particles (B) having an average particle diameter of 0.2 to 19.4 μm and having a glass transition temperature (TG) of 32° C. to 59° C. having vinyl monomer-derived structural units comprising 94.66 wt. % to 100 wt. % of vinyl acetate units, wherein the polymer particles (B) are obtained by an emulsion polymerization method, suspension polymerization method or dispersion polymerization method in the presence of said cationic starch having a nitrogen content (N %) of 0.2 to 0.8 percent (A), such that the proportion of (A) is from 10 to 315 parts by weight relative to 100 parts by weight of the polymer particles (B); and wherein the polymer emulsion has a solid content of 7.9 to 39% by weight;

filtering said mixture on a wire mesh to drain water out to form a paper layer, wherein said polymer emulsion is added to said pulp slurry at the time of papermaking, and wherein the emulsion polymerization method, suspension polymerization method or dispersion polymerization method is carried out in the presence of a surfactant.

3. A method of improving stiffness of paper comprising:

bringing pulp into contact with a polymer emulsion comprising a cationic starch having a nitrogen content (N %) of 0.2 to 0.8 percent (A) and polymer particles (B) having an average particle diameter of 0.2 to 19.4 μm and comprising at least vinyl monomer-derived structural units comprising 94.66 wt. % to 100 wt. % of vinyl acetate units, wherein the polymer particles (B) are obtained by an emulsion polymerization method, suspension polymerization method or dispersion polymerization method in the presence of said cationic starch having a nitrogen content (N %) of 0.2 to 0.8 percent (A), such that the proportion of (A) is from 10 to 315 parts by weight relative to 100 parts by weight of the polymer particles (B); wherein the polymer emulsion has a solid content of 7.9 to 39% by weight; and wherein the glass transition temperature (TG) of (B) is from 32° C. to 59° C.;

wherein said pulp is contacted with said polymer emulsion at the time of papermaking, and wherein the emulsion polymerization method, suspension polymerization method or dispersion polymerization method is carried out in the presence of a surfactant.

4. The method according to claim 1, in which the vinyl monomer-derived structural unit comprises 2.43 wt. % or less of a polymerizable unsaturated group containing anionic monomer.

5. The method according to claim 1, in which the vinyl monomer-derived structural unit comprises 2.78 wt. % or less of a nonionic hydrophilic group containing monomer.

6. A method of making paper according to claim 1, wherein the vinyl monomer-derived structural units comprise 100 wt. % of vinyl acetate units.

7. A method of making paper according to claim 2, wherein the vinyl monomer-derived structural units comprise 100 wt. % of vinyl acetate units.

8. A method of making paper according to claim 3, wherein the vinyl monomer-derived structural units comprise 100 wt. % of vinyl acetate units.

9. The method according to claim 1, wherein an aqueous solution of the cationic starch (A) has a viscosity of 40 to 10,000 mPa·s at a concentration of 7 wt. % at 50° C.

* * * * *